US006481050B1

(12) United States Patent
Wilson et al.

(10) Patent No.: US 6,481,050 B1
(45) Date of Patent: Nov. 19, 2002

(54) MOTOR-FAN COOLING AIR DIRECTED INTO FILTER BAG

(75) Inventors: Robert S. Wilson, New Philadelphia, OH (US); William H. Theiss, Canton, OH (US)

(73) Assignee: The Hoover Company, North Canton, OH (US)

( * ) Notice: Subject to any disclaimer, the term of this patent is extended or adjusted under 35 U.S.C. 154(b) by 12 days.

(21) Appl. No.: 09/619,293

(22) Filed: Jul. 19, 2000

(51) Int. Cl.[7] ..... A47L 9/00
(52) U.S. Cl. ..... 15/413; 417/372
(58) Field of Search ..... 15/413; 417/372

(56) References Cited

U.S. PATENT DOCUMENTS

| | | | | | |
|---|---|---|---|---|---|
| 1,342,592 | A | * | 6/1920 | Orr | 110/163 |
| 1,878,858 | A | * | 9/1932 | Kitto | 15/344 |
| 1,986,976 | A | * | 1/1935 | Kitoo | 15/413 |
| 2,031,911 | A | * | 2/1936 | Smellie | 15/413 |
| 2,073,489 | A | * | 3/1937 | Leathers | 15/344 |
| 4,621,991 | A | | 11/1986 | Smith et al. | |
| 5,638,575 | A | | 6/1997 | Sin | |
| 6,308,374 | B1 | * | 10/2001 | Bobrosky et al. | 15/340.2 |

FOREIGN PATENT DOCUMENTS

| | | |
|---|---|---|
| EP | 321690 | 6/1987 |
| EP | 826332 | 4/1998 |
| FR | 1483158 | 6/1967 |
| GB | 783733 | 9/1955 |
| JP | 08010192 A | 1/1996 |
| JP | 10084657 | 3/1998 |
| SU | 1644897 | 4/1991 |

* cited by examiner

*Primary Examiner*—Chris K. Moore
(74) *Attorney, Agent, or Firm*—A. Burgess Lowe; Michael J. Corrigan

(57) ABSTRACT

A vacuum cleaner having a main body and a handle, the main body being formed with a nozzle which delivers a stream of dirt-laden air through a dirt duct through a motor-fan inlet, the handle being supported on the motor-fan assembly and housing a filter bag which communicates with the motor-fan assembly for receiving the dirt-laden air, the motor-fan assembly having a motor housing, a motor with commutated brushes which give off carbon dust particles, a motor cooling fan for drawing a cooling airstream and a working fan for drawing the dirt-laden air, the vacuum comprising: an opening formed in the motor housing for receiving the cooling airstream; a cooling outlet formed in the motor housing through which the cooling airstream exists; means for directing the existing cooling airstream into the dirt-laden air; a collar extending axially outwardly from the motor housing, the collar allowing pivotal rotation of the motor housing relative to the main body.

4 Claims, 12 Drawing Sheets

MOTOR-FAN COOLING AIR DIRECTED INTO FILTER BAG

TECHNICAL FIELD

The present invention relates generally to a motor-fan assembly in an upright vacuum cleaner. More particularly, the present invention relates to a motor-fan assembly that directs the cooling air from the motor-fan assembly into a filter bag of a vacuum cleaner.

DISCLOSURE OF INVENTION

In the vacuum cleaner art, a motor-fan assembly is typically used as a vacuum source for drawing dirt laden air through a nozzle formed in the main body of the vacuum cleaner and directing that air into a filter bag. Known motor-fan assemblies, therefore, have a fan driven by a motor that draws the dirty working air into the motor housing and expels the dirty air through a motor fan outlet into the filter bag. To cool the motor, a cooling fan draws relatively cool air though an intake, across the components of the motor for cooling thereof before expelling the heated air out an exhaust vent. During its passage across the components of the motor, the cooling air may pick up particles discharged by the motor such as carbon or copper particles and carry these particles out the exhaust vent.

To prevent the venting of these particles into the atmosphere, it is known to route the cooling air into the working air intake, thus routing the cooling air into the filter bag along with the working air. In this manner, the particles discharged by the motor are captured in the filter bag. To perform the carbon capture, it is known to provide a vacuum cleaner motor within a fixedly mounted casing formed with a plurality of air inlets or vents. The motor drives a working fan which communicates with and draws air through a vacuum chamber. A channel extends between the motor housing compartment and the vacuum chamber creating a passage for the cooling air to be drawn into the vacuum chamber. As the working fan rotates within the fan compartment, a partial vacuum is created within the chamber which either by itself or in cooperation with a cooling fan draws the cooling air through the air inlets and is drawn into the motor casing to cool the motor. This air then flows through the channel into the vacuum chamber where it is discharged through a dirty air duct and into a vacuum cleaner filter bag.

Heretofore, these prior art arrangements that direct the cooling air, into the filter bag have been adequate for the purpose for which they are intended, however in many upright vacuum cleaners the motor-fan casing is attached to the upper housing of the vacuum cleaner and rotates relative to the foot of the vacuum cleaner. Because the prior art arrangements were incorporated into vacuum cleaners having a stationary motor-fan casing, these prior art arrangements are not suitable for uprights wherein the motor hosing rotates relative to the foot, as a constant communication must be maintained between the exhaust vents of the rotating motor casing and the stationary working air ducts of the foot.

Therefore, the need exists for an upright vacuum cleaner which directs cooling air from the motor-fan assembly into the filter bag yet permits rotational movement between the motor-fan casing and the foot.

SUMMARY OF THE INVENTION

The present invention, therefore provides, an improved vacuum cleaner having a main body and a handle. The main body being formed with a nozzle which delivers a stream of dirt-laden air through a dirt duct into a motor-fan inlet. The handle being supported on the motor-fan assembly and housing a dirt collecting container which communicates with the motor-fan assembly via an outlet for receiving the dirt-laden air. The motor-fan assembly includes a motor housing, a motor with commutator brushes which give off carbon dust particles, a motor cooling fan for drawing a cooling airstream and a working fan for drawing the dirt-laden airstream. An opening is formed in the motor housing for receiving the cooling airstream. A cooling outlet is formed in the motor housing through which the cooling airstream exits the motor housing. A duct directs the existing cooling airstream into the dirt-laden airstream and includes a sleeve extending axially outwardly from the motor housing. The sleeve allows for pivotal rotation of the motor housing relative to the main body.

The present invention further provides a motor fan assembly in a vacuum cleaner which includes a motor having commutator brushes located within a motor housing. The motor housing has a cooling inlet located near the commutator brushes, a working air inlet, and a working air outlet formed therein. The working air outlet fluidly communicates with the working air inlet and a working fan is positioned between the working air inlet and working air outlet. The working fan is driven by the motor wherein the working fan draws dirt laden working air into the motor housing through the working air inlet and blows the working air out of the motor housing through the working air outlet. A cooling outlet is formed opposite the working air inlet, wherein cooling air entering the cooling inlet exits the motor housing through the cooling outlet. A duct is rotatably supported on the motor housing adjacent said cooling outlet and communicates with the cooling outlet and the working air inlet, whereby air exiting the cooling outlet is directed into the dirt laden airstream and blown out the working air outlet to a dirt collecting container.

The present invention further provides a motor-fan assembly for a vacuum cleaner which includes a motor housing having a cooling air inlet, a working air inlet, and a working air outlet formed therein. The working air outlet fluidly communicates with the working air inlet. A motor is positioned within the housing having a motor shaft. A cooling fan is positioned adjacent the cooling air inlet and is coupled to the motor shaft. The cooling fan draws cooling air into the motor housing through the cooling air inlet to cool the motor. A working fan is positioned between the working air inlet and the working air outlet and is coupled to the shaft. The working fan drawing working air into the motor housing through the working air inlet and blows the working air out of the motor housing through the working air outlet. At least one hole is formed in the working fan allowing the cooling air to flow through the working fan and be blown out the working air outlet.

BRIEF DESCRIPTION OF THE DRAWINGS

For a complete understanding of the objects, techniques and structure of the invention, reference should be made to the following detailed description and accompanying drawings wherein.

Similar numerals refer to similar parts throughout the drawings.

DETAILED DESCRIPTION OF THE INVENTION

Figure 1:
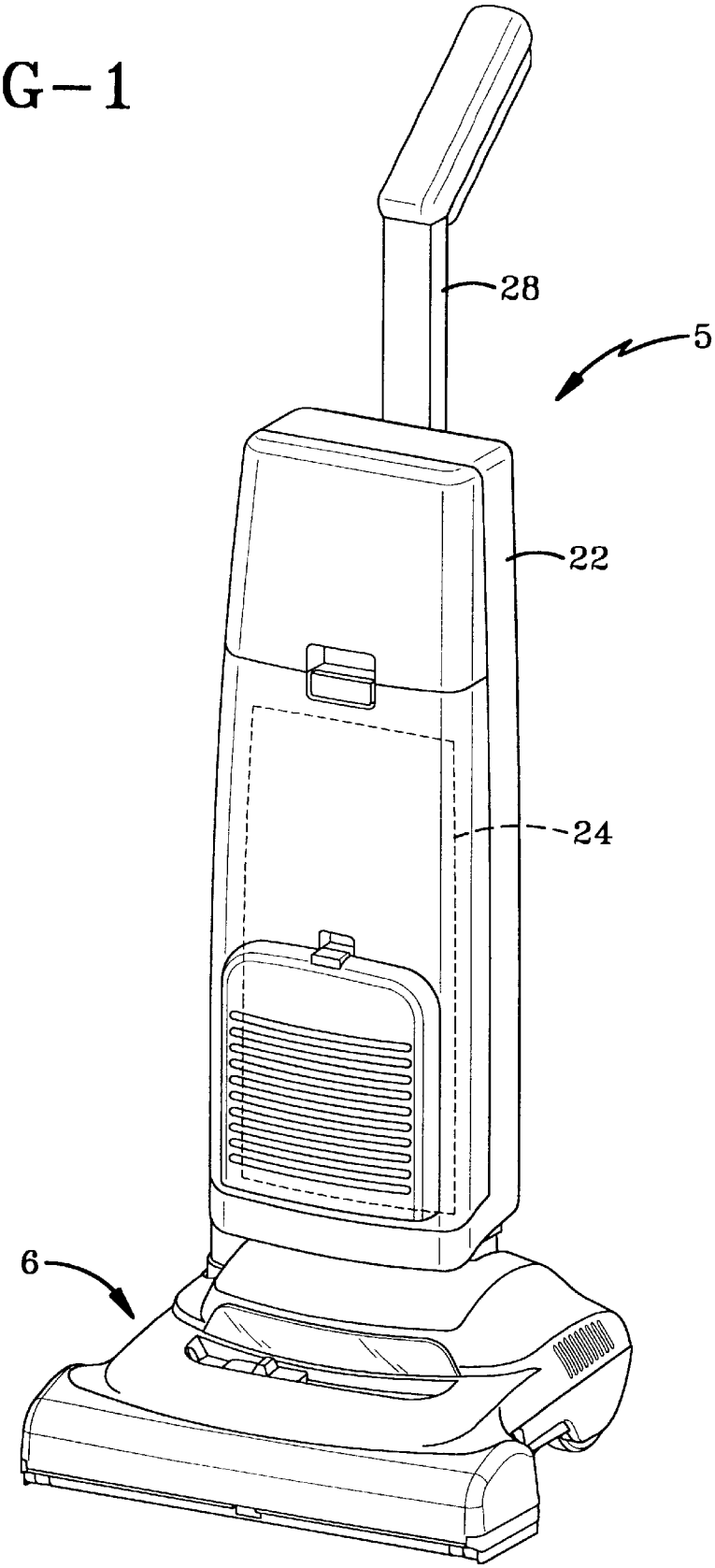
FIG. 1 is a perspective view of an upright vacuum cleaner.
Figure 13:
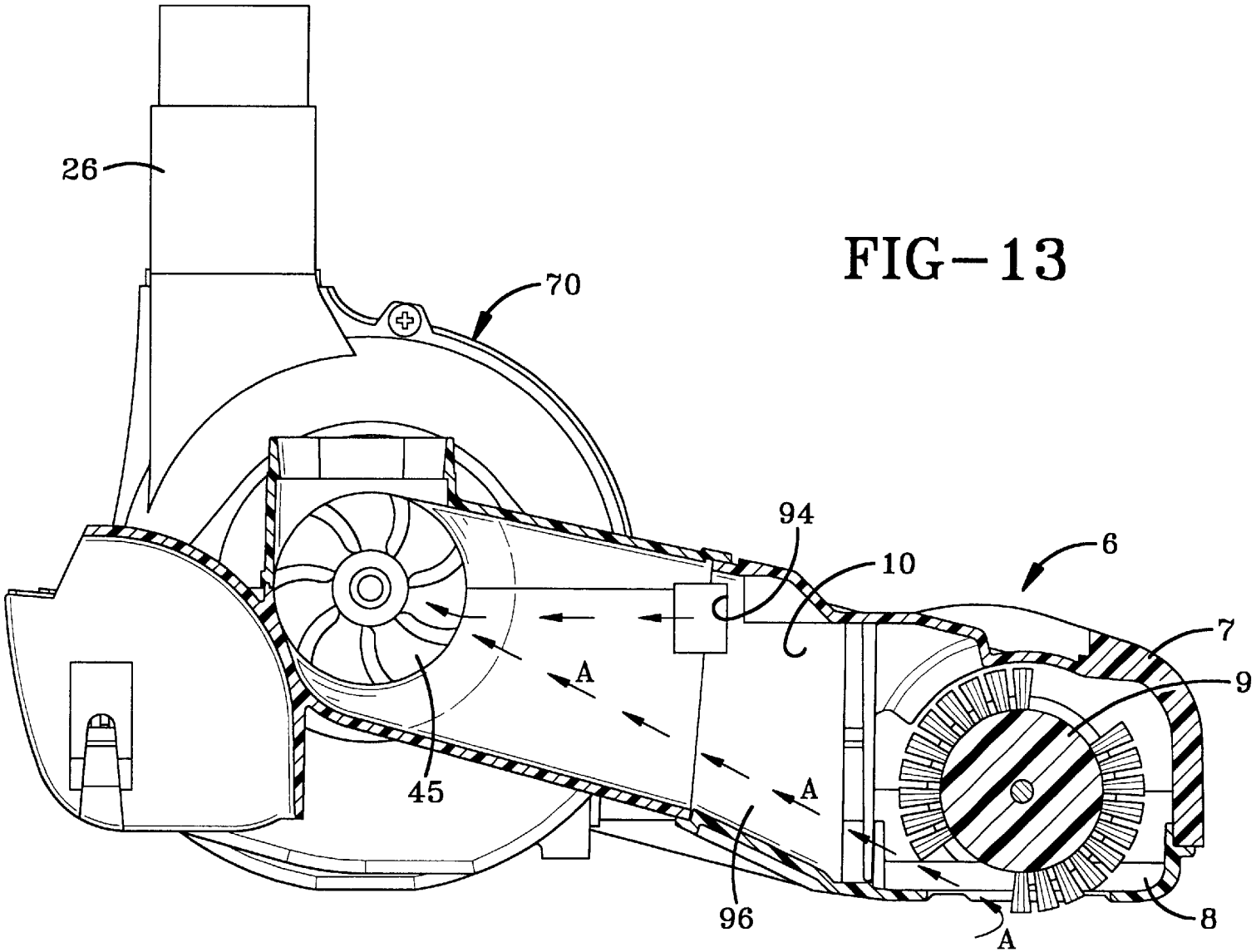
FIG. 13 is a sectional view taken along line 11—11, FIG. 10 depicting the cooling airstream exiting the duct and being drawn into the working fan.

A conventional vacuum cleaner is shown in FIG. 1 and is indicated generally at 5. It will be understood that vacuum cleaners are well known in the art and thus vacuum cleaner 5 will be described in general terms. With reference to FIG. 13, vacuum cleaner 5 includes a conventional floor engaging main body or foot 6 having a nozzle 7 formed with a nozzle opening 8. An agitator 9 is rotatably mounted within nozzle 7. A dirt duct 10 is formed in main body 6 and communicates at one end with nozzle 7 and at an opposite end with a vacuum generating means in the form of a motor-fan assembly 20. The motor-fan assembly 20 communicates with dirt duct 10 to draw a flow of dirt laden air, indicated by arrows A, through the main body 6 and into a dirt collecting filter bag 24 (FIG. 1). Filter bag 24 is housed within a vacuum cleaner upper housing 22 (FIG. 1). Referring back to FIG. 13, a vacuum pressure is generated at the nozzle 7 to draw dirt and debris loosened from a floor surface by agitator 9 through the nozzle opening 8 and dirt duct 10. The motor-fan assembly 20 then transmits the dirt laden air from the main body 6, through an air duct 26 and into the dirt collecting filter bag 24 which communicates with air duct 26.

The dirt collecting filter bag is formed of an air pervious material such as, for example, paper or cloth and functions to filter all the dirt laden air and collect the dirt, dust and other particles therein. Alternatively, the dirt laden air may be blown into a container or dirt cup that is largely impervious to air with the exception of an opening that communicates externally of the dirt cup through a filter. Typically in this type of bagless vacuum cleaner a cyclonic action is used in combination with a filter for separating the particulate and traping these particles within the dirt cup. For simplicity, a dirt cup and a filter bag will be referred to generally as filter bag. Referring to FIG. 1, the filter bag may be supported on a substantially vertically extending pivoting handle 28. Motor-fan assembly 20 is rotatably supported within the main body 6 and may further be provided with a detent 32 (FIGS. 2 and 3) for restricting the rotation of motor-fan assembly 20 which, in turn, restricts the rotation of handle 28.

Figure 4:
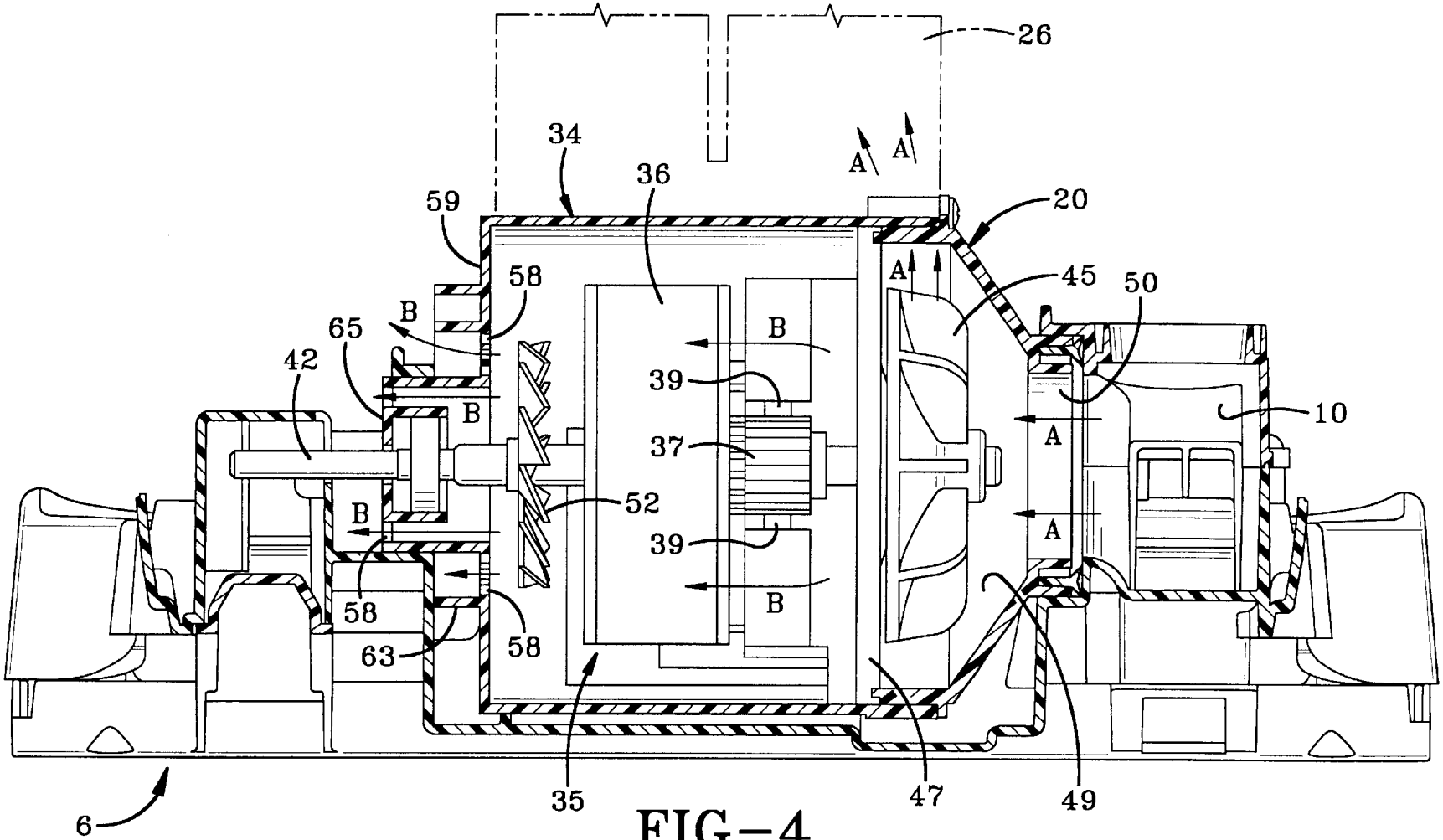
FIG-4 PRIOR ART
FIG. 4 is a sectional view of the main body of the vacuum cleaner, of FIG. 1 depicting the internal components of the prior art motor fan assembly of FIG. 2.

Referring specifically to FIG. 4, motor fan assembly 20 includes a motor housing 34 which encloses a motor 35. Motor 35 includes a field coil, diagrammatically represented at 36, a commutator 37 and a pair of carbon brushes 39 which ride on the commutator 37 to connect the rotor coil to a stationary circuit by a near frictionless contact, as is known in the art. Motor 35 rotatably drives a shaft 42 to which a working fan 45 is suitably coupled such that the working fan 45 rotates with shaft 42. Working fan 45 may be separated from motor 35 by a wall 47 substantially defining a working fan chamber 49 between the wall 47 and housing 34. A working air inlet 50 is formed within the housing 34 near working fan 45 for receiving the dirt laden air. Working air inlet 50 communicates with nozzle opening 8, such that, when the motor 35 drives fan 45, the fan 45 draws dirt laden air through nozzle opening 8 and dirt duct 10 and blows the dirt laden air or working air out air duct 26, as shown by arrows A of FIG. 4.

Figure 3:
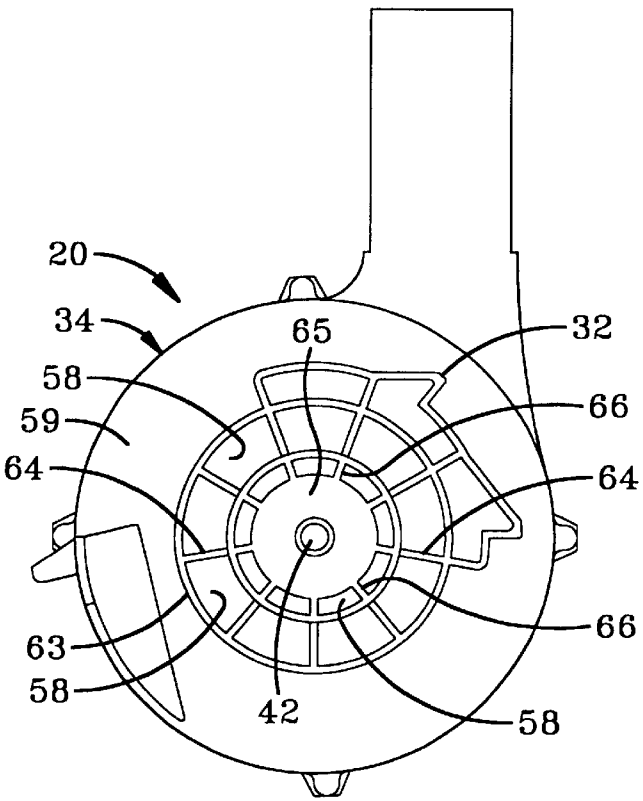
FIG-3 PRIOR ART
FIG. 3 is a side elevational view of the prior art motor fan assembly of FIG. 2.
Figure 2:
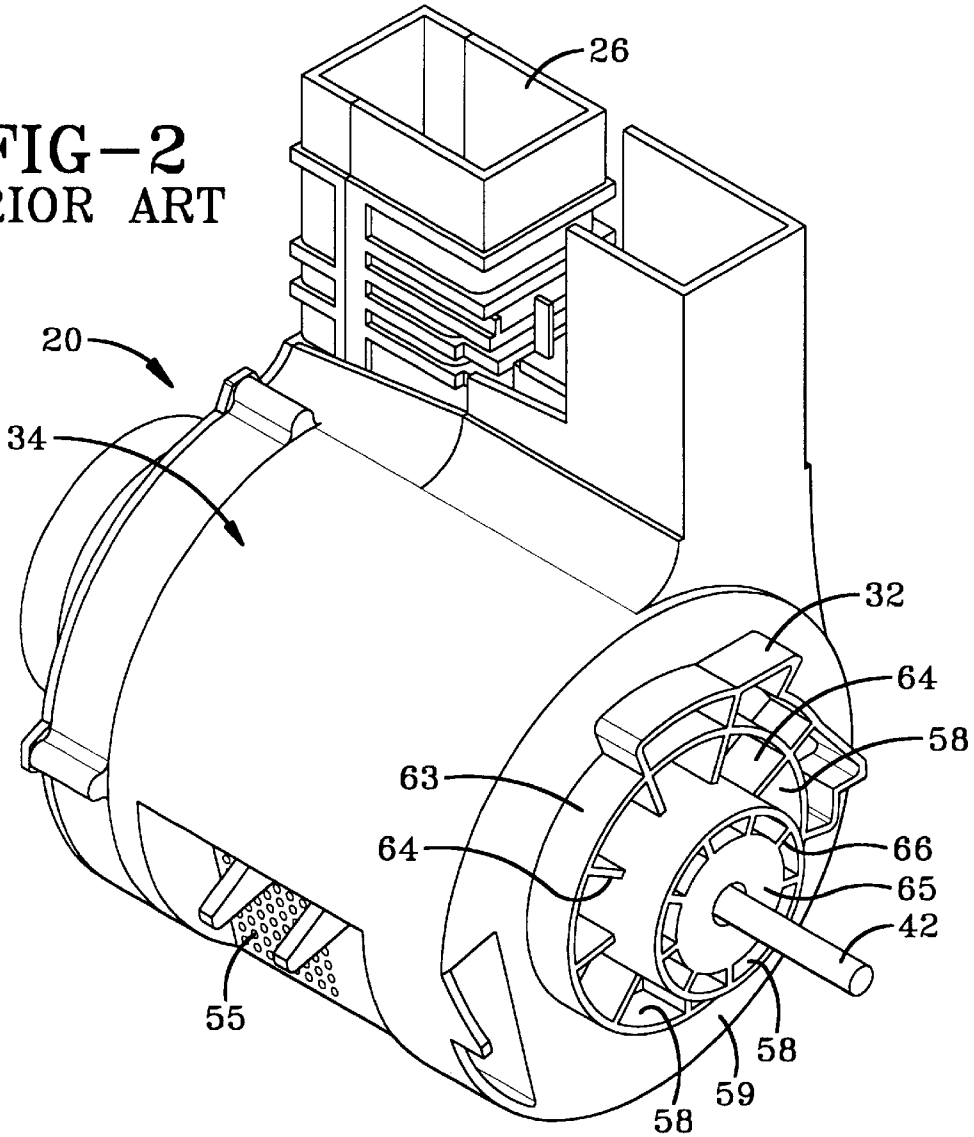
FIG-2 PRIOR ART
FIG. 2 is a perspective view of a prior art motor fan assembly.

Referring still to FIG. 4, as motor 35 rotates within housing 34, heat is generated between the commutator 37 and carbon brushes 39 as well as between the armature and field winding of motor 35. To prevent overheating of motor 35, a cooling fan 52 is provided on the end of shaft 42 opposite working fan 45. Cooling fan 52 draws a stream of cooling air, indicated by arrows B of FIGS. 2 and 4, into housing 34 through a plurality cooling air inlets 55 (FIG. 2) formed in a front face 56 of the motor housing 34. The cooling air flows across commutator 37, carbon brushes 39, field coil 36 and the armature of motor 35 and is expelled from motor housing 34 through a plurality of exhaust openings 58 (FIGS. 2 and 3) which are formed in an exhaust end 59 of motor housing 34. Exhaust end 59 is located on an end of housing 34 opposite working air inlet 50. As shown in FIGS. 2 and 3, a collar 63 extends outwardly from the exhaust end 59 of housing 34 and includes a plurality of radially extending support ribs 64. A stepped portion 65 extends outwardly from the center of collar 63 and include a plurality of radially extending support ribs 66. Exhaust openings 58 are formed between ribs 64 of collar 63 and ribs 66 of stepped portion 65. As the commutator turns and is contacted by the carbon brushes, the brushes emit carbon dust which gets picked up by the cooling air and blown out exhaust openings 58.

Figure 6:
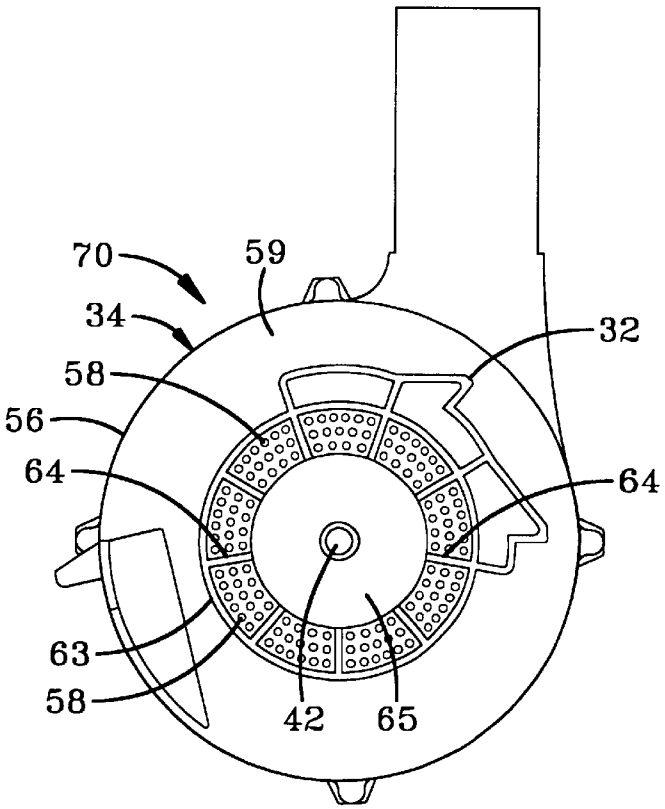
FIG. 6 is a side elevational view thereof.
Figure 5:
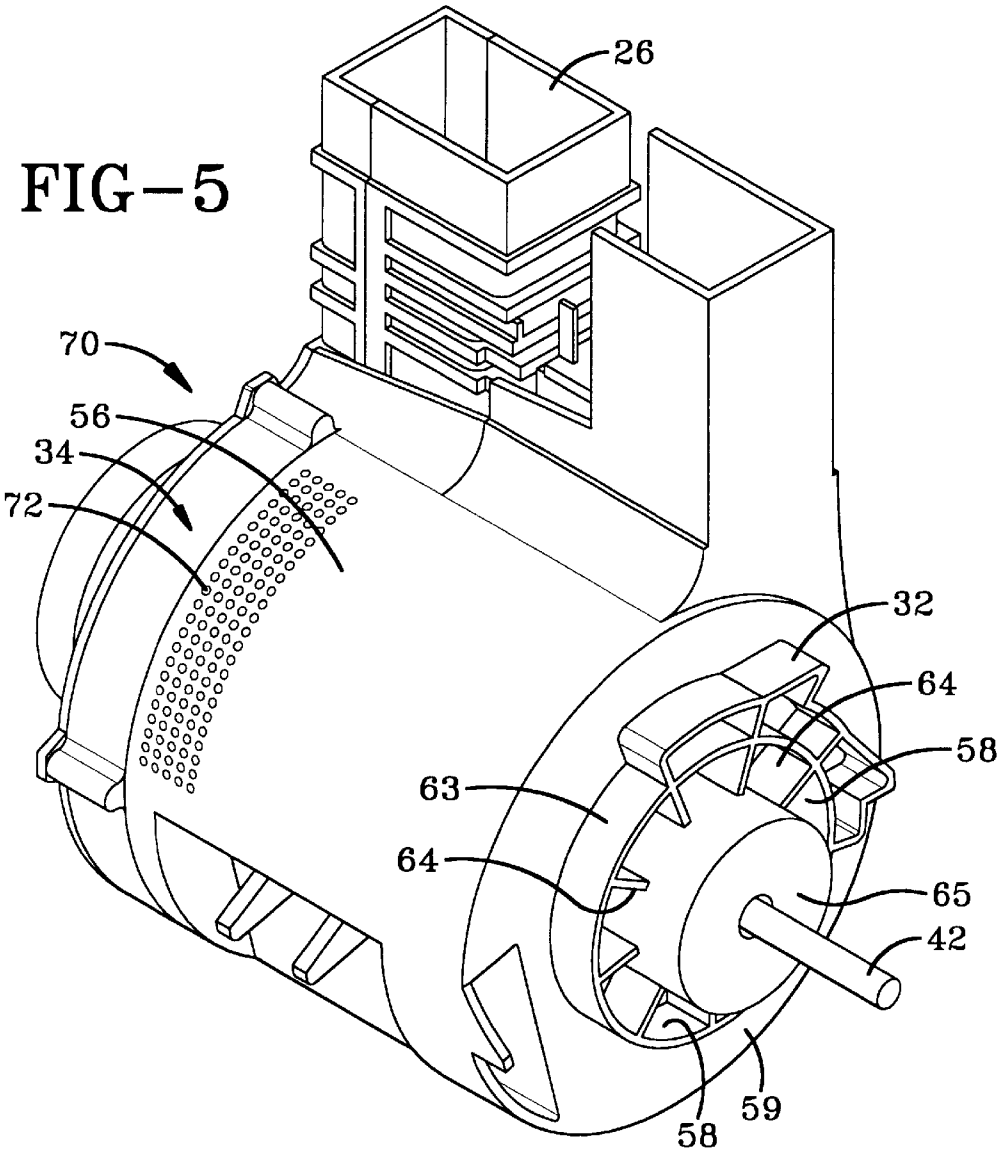
FIG. 5 is a perspective view of a first embodiment of a motor fan assembly according to the present invention.

In accordance with the invention, it is desirable to capture this cooling air exhaust and the carbon particles contained therein and filter the carbon dust laden cooling air through the filter bag 24. One embodiment of a motor fan assembly which provides for directing the cooling air exhaust into a filter bag is shown in FIGS. 5–8 and 11–13 and is indicated generally at 70. Motor fan assembly 70 is substantially similar to motor fan assembly 20 and includes a cooling air inlet opening 72 (FIG. 5) formed in the front face 56 of motor housing 34. The inlet opening 72 is located substantially over the commutator 37 and carbon brushes 39 so as to specifically direct the cooling air across the commutator and brushes to reduce the heat created there between. By pinpointing the hottest locations of the motor and directing the cooling air across these hot spots, motor fan assembly 70 is more efficiently cooled, thus requiring less airflow thereacross. Inlet opening 72 may be a single opening, a number of openings, or may be constructed of plurality of perforations. As shown in FIG. 5, inlet opening 72 may extend radially along the front face 56 of housing 34 to cover a large radial section of the housing 34. Referring to FIGS. 5 and 6, stepped portion 65 of the exhaust end 59 of the motor housing has its exhaust openings 58 sealed to prevent air flow therethrough. The exhaust openings formed in collar 63 remain open requiring all of the cooling air exhaust to flow between the ribs 64 of the collar.

Figure 9:
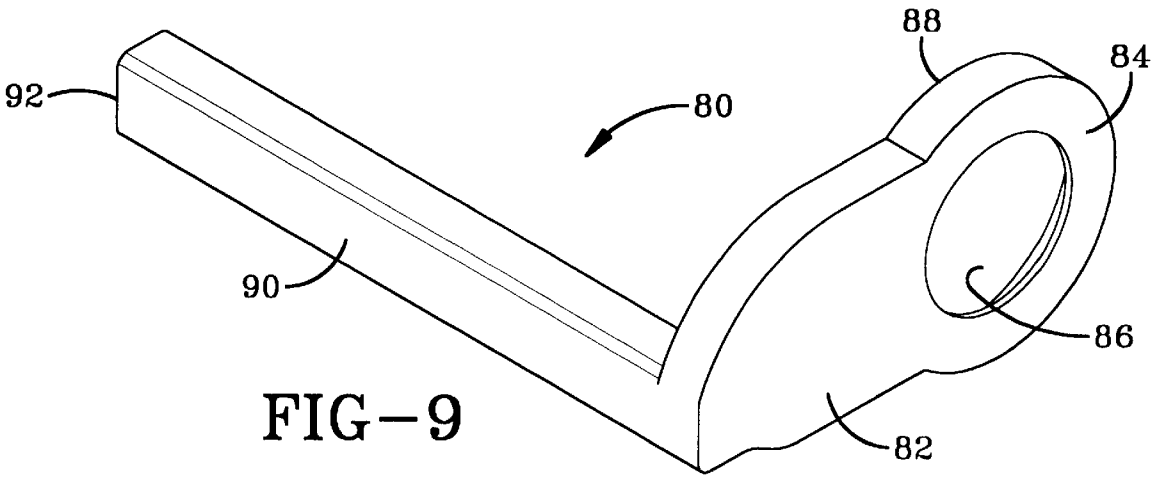
FIG. 9 is a perspective view of a first embodiment of a duct for capturing cooling air exiting the motor fan assembly depicted in FIGS. 5 and 6.
Figure 11:
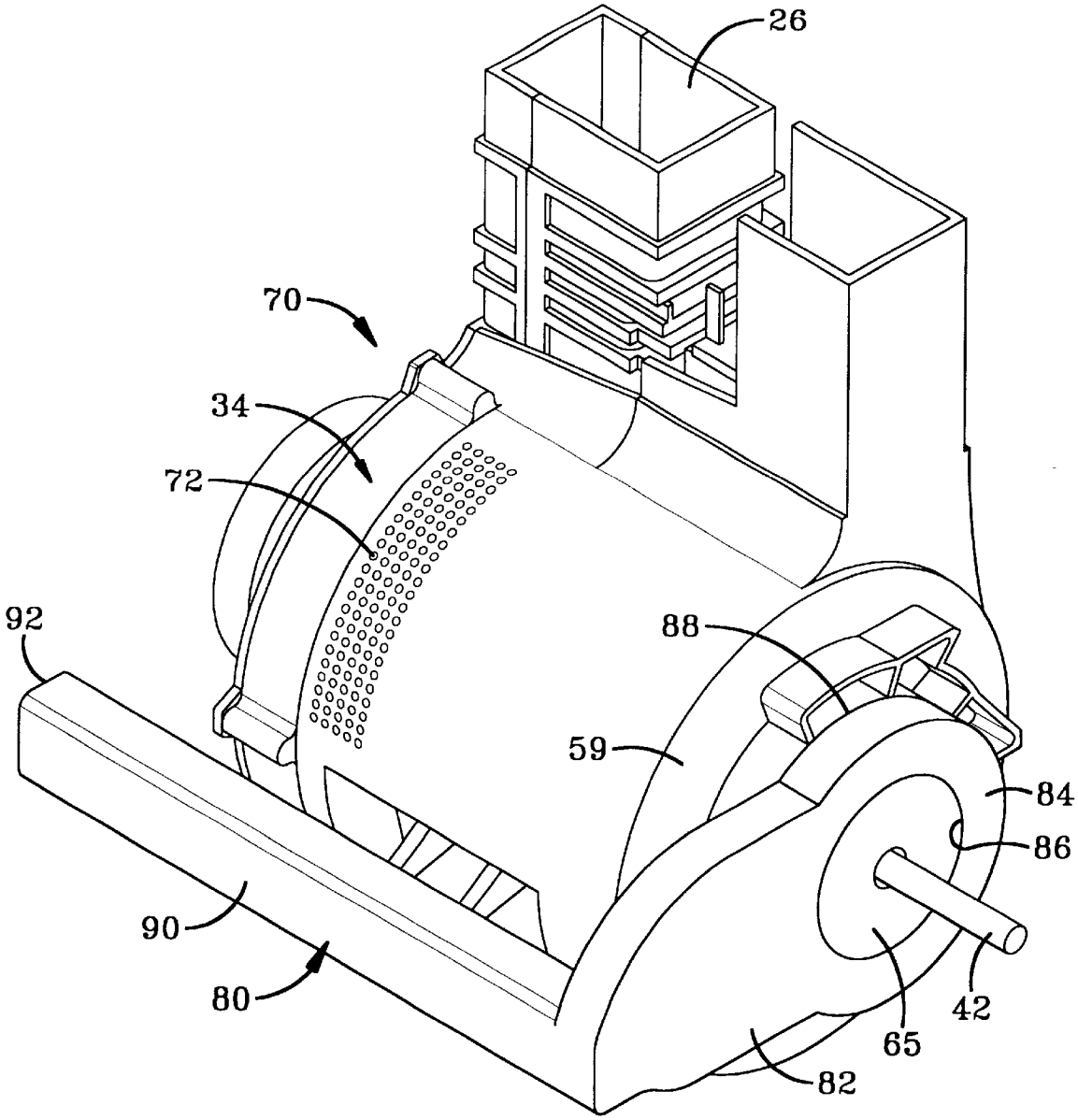
FIG. 11 is a perspective view of the assembled first embodiment of the motor fan assembly and first embodiment of the duct.

Referring now to FIG. 11, a duct 80 is rigidly mounted on main body 6 and fluidly connects to exhaust end 59 of the housing 34 to capture the cooling air exhaust as the cooling air passes through exhaust openings 58. It will be appreciated that duct 80 may be of any shape limited to an extent by the interior of the main body 6 and the housing 34. As shown in FIG. 9, duct 80 includes a sleeve or hood 82 having a hollow radial end portion 84 shaped to matingly engage exhaust end 59 of housing 34 (FIG. 9). Particularly, sleeve 82 is provided with an opening 86 sized to rotatably receive the stepped portion 65 housing exhaust end 59, as shown in FIG.9. Opening 86 allows sleeve 82 to fit snugly over stepped portion 65 for providing fluid communication between exhaust openings 58 and duct 80. Sleeve 82 includes an inner edge 88 (FIG. 12) which abuts the end of housing 34 to substantially seal the fluid connection between the duct 80 and the exhaust openings 58. The abutting contact between the inner edge 88 of sleeve 82 and the rotatable non-rigid engagement between opening 86 and stepped portion 65 allow motor fan assembly 70 to rotate relative to main body 6 when upper housing 22 pivots during use of vacuum cleaner 5. Thus, sleeve 82 allows the motor fan assembly to rotate with the upper housing while maintaining constant fluid communication between the exhaust openings and duct 80 allowing duct 80 to continuously capture the carbon dust laden cooling air.

Figure 12:
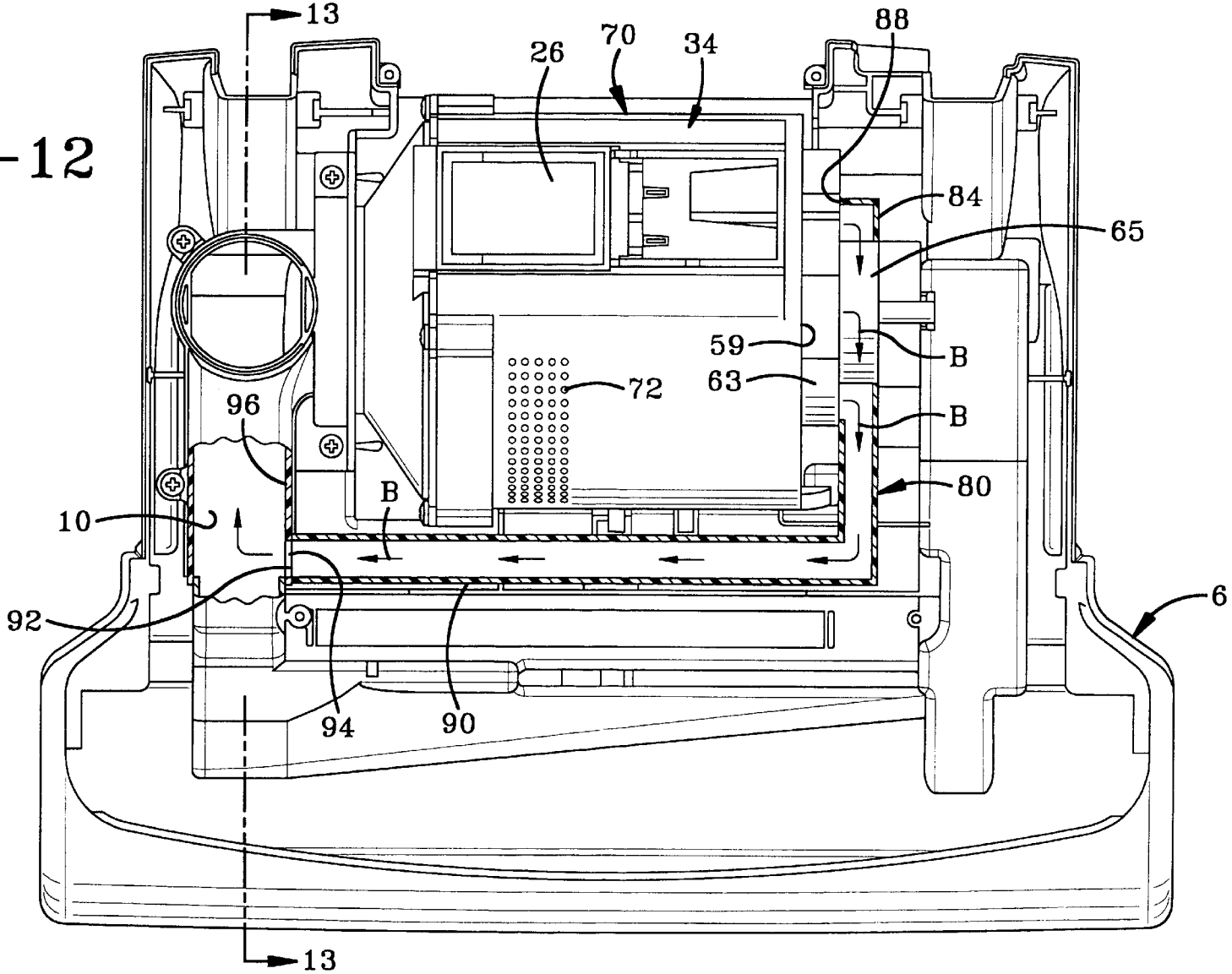
FIG. 12 is a top elevational view of the main body of the vacuum of FIG. 1 with the motor cover and handle removed depicting the first embodiment of the duct in section and a portion of a working air inlet broken away to show the communication of the duct and inlet and further depicting the captured flow of cooling air entering the working air inlet.

Referring to FIGS. 9, 11 and 12, the hollow interior of sleeve 82 communicates with a transverse portion 90 of the duct 80 which extends within main body 6 generally perpendicular to sleeve 82. Transverse portion 90 of duct 80 includes a distal end 92 which communicates with an opening 94 (FIGS. 12 and 13) formed in an inner side wall 96 of dirt duct 10. As shown in FIGS. 12 and 13, the opening 94 allows the cooling air exhaust (indicated by arrows B) flowing through duct 80 to be combined with the working air and blown into the filter bag 24 by working fan 45, as described above. By combining the carbon dust laden cooling air with the working air the carbon particles can be separated from the air flow by the filter bag 24 thus providing cleaner overall emissions from the vacuum cleaner 5. It is understood that duct 80 may be a separate member, as shown in FIGS. 9 and 11 or may be integrally molded with main body 6 (FIG. 12). Sleeve 82 provides for a continuous sealed relationship between the stationary duct 80 and the motor housing 34 yet allows rotational movement of motor fan assembly 70 relative to main body 6.

It is well known that electric motors discharge ozone gas. This ozone gas which is discharged from motor 35 combines with the carbon dust laden cooling air and is blown out of motor housing 34 through exhaust openings 58. As described above, duct 80 captures the exhaust air from motor fan assembly 70, and thus the ozone gas, and directs the combined cooling air exhaust and ozone gas into filter bag 24. It is also well known in the art that ozone gas acts as an odor neutralizer which, when blown into the filter bag 24, will assist in killing bacteria and neutralizing odors which are emitted by the dust, dirt and debris picked up by vacuum cleaner 5.

Figure 10:
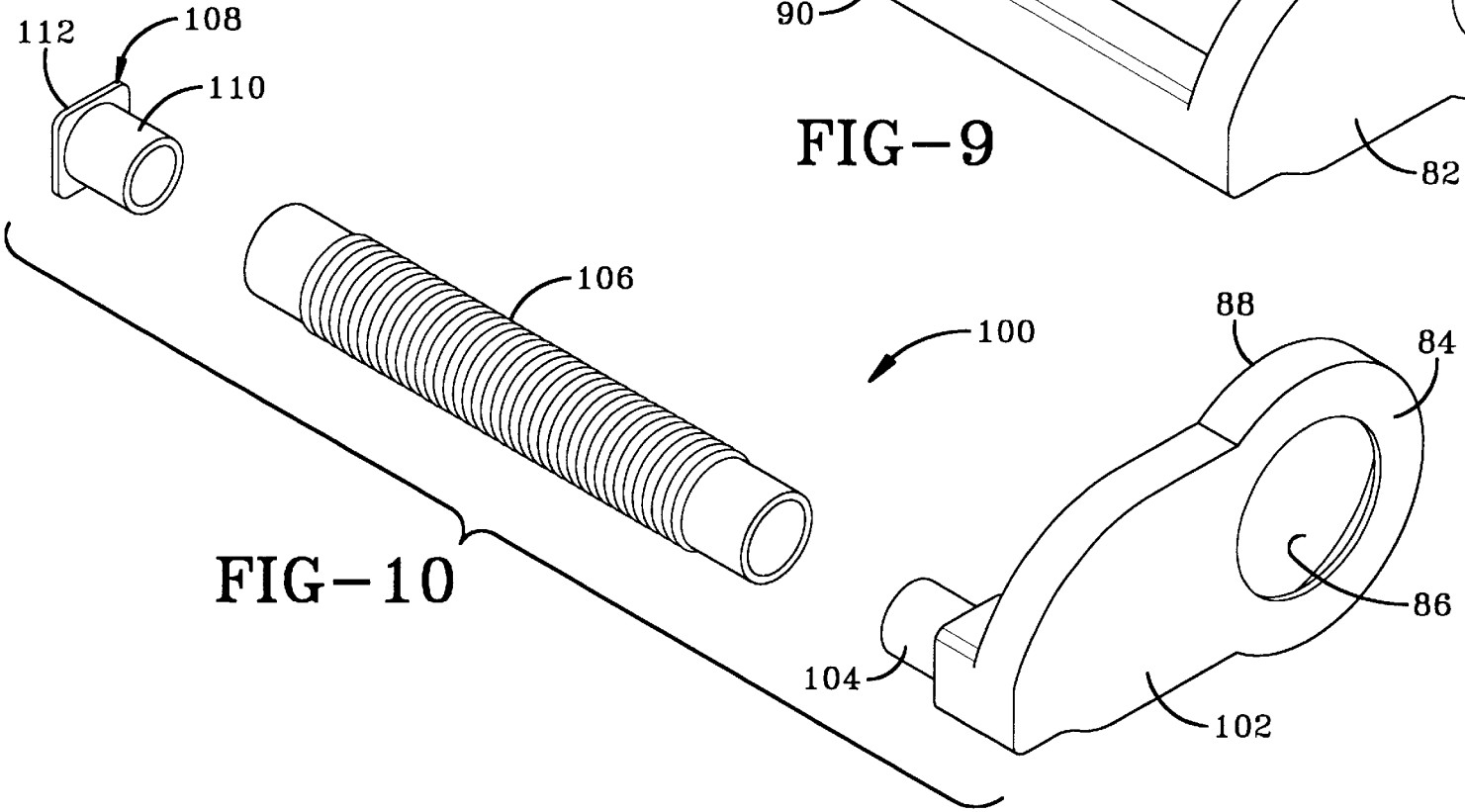
FIG. 10 is a perspective view similar to FIG. 7 showing a second embodiment of the duct.

Duct 80 is shown in FIGS. 9 and 11 as an integrally formed one-piece member but it is understood that duct 80 may also be formed of several pieces without affecting the concept of the invention. Such a several piece duct is shown in FIG. 10 and is indicated generally at 100. Duct 100 includes a sleeve 102 substantially similar to sleeve 82 of duct 80 and includes a nipple 104 extending outwardly perpendicular to the front end of sleeve 102. A flexible tube or hose 106 engages nipple 104 and extends transversely across main body 6. Flexible tube 106 may be formed of any suitable flexible hose or tubing, such as a corrugated tubing or a smooth rubber or plastic hose. A connector 108 having a nipple 110 and a rigid flange 112 attaches to the end of tube 106 opposite sleeve 102. Flange 112 may be slidably received within a groove (not shown) formed on each side of opening 94 for attaching the end of duct 100 to the wall of dirt duct 10.

The ducts 80 and 100 may be otherwise placed in communication with the working air inlet 50 such that, as shown in FIG. 11, the cooling air is directed into the working airstream. In this way, the cooling air exhausted from the motor is blown into the filter bag 24 by the motor fan assembly 70. Any particulate such as carbon from the commutator brushes may be trapped within the filter bag 24 preventing these particles from entering the atmosphere. Further, ozone produced by the motor 35 may be directed into the working airstream killing bacteria entrained in the working air.

First and second ducts 80 and 100 which fit around stepped portion 65 of housing 34 permit rotational movement of the motor housing 34 while maintaining communication between the cooling air outlet 58 and the dirt duct 10. An opening 94 may be formed in the dirt duct 10 to establish communication between the dirt duct and transverse portion 90 and hose 106. In either embodiment, the ducts 80 and 100 are stationary on the main body 6 of vacuum cleaner 5. With the duct fixed, the step portion 65 of motor housing 34 rotates within the duct when the handle 28 is pivoted during use of vacuum cleaner 5. Since the cooling outlet 58 is covered by the ducts 80 and 100, the ducts maintains fluid communication with the outlet 58 throughout rotation. To ensure that the ducts do not occlude the cooling air inlet 55, the transversely extending portions of the ducts may be spaced radially outward from the motor housing 34 to provide a gap through which air can reach the cooling inlet 55. Alternatively, the cooling air inlet may be provided with a cover for directing air peripherally along the surface of motor housing 45 and preventing the transverse portion of the ducts from contacting the cooling inlet 55. By determining the hotspots of the motor 35 the cooling air can be directed to these hotspots for providing a more efficient cooling of motor 35. As shown in FIG. 11, the cooling air inlet 55 is formed radially in the front face 56 of the motor housing 34 at a location overlying the commuator 37 and carbon brushes 39.

Figure 8:
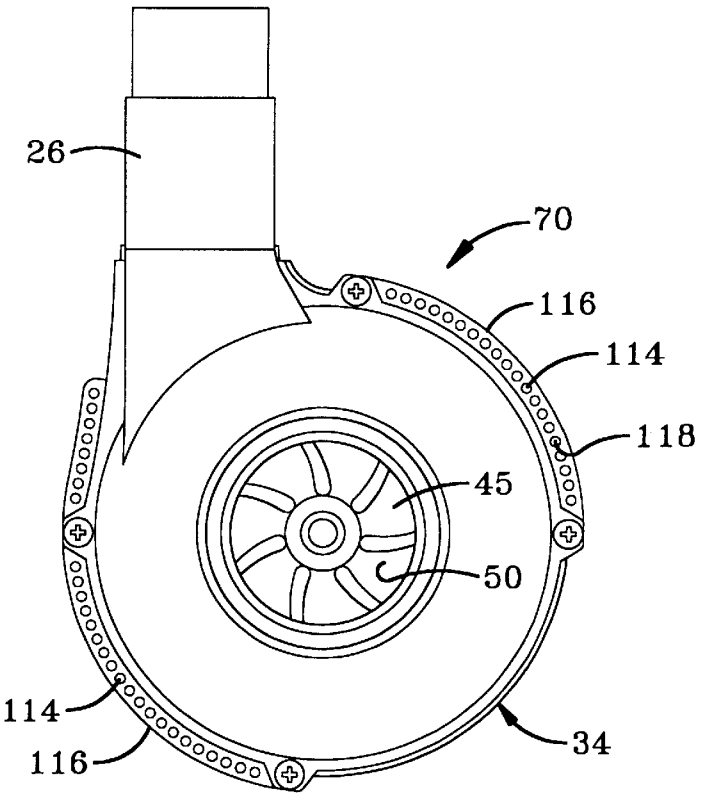
FIG. 8 is a side view thereof.
Figure 7:
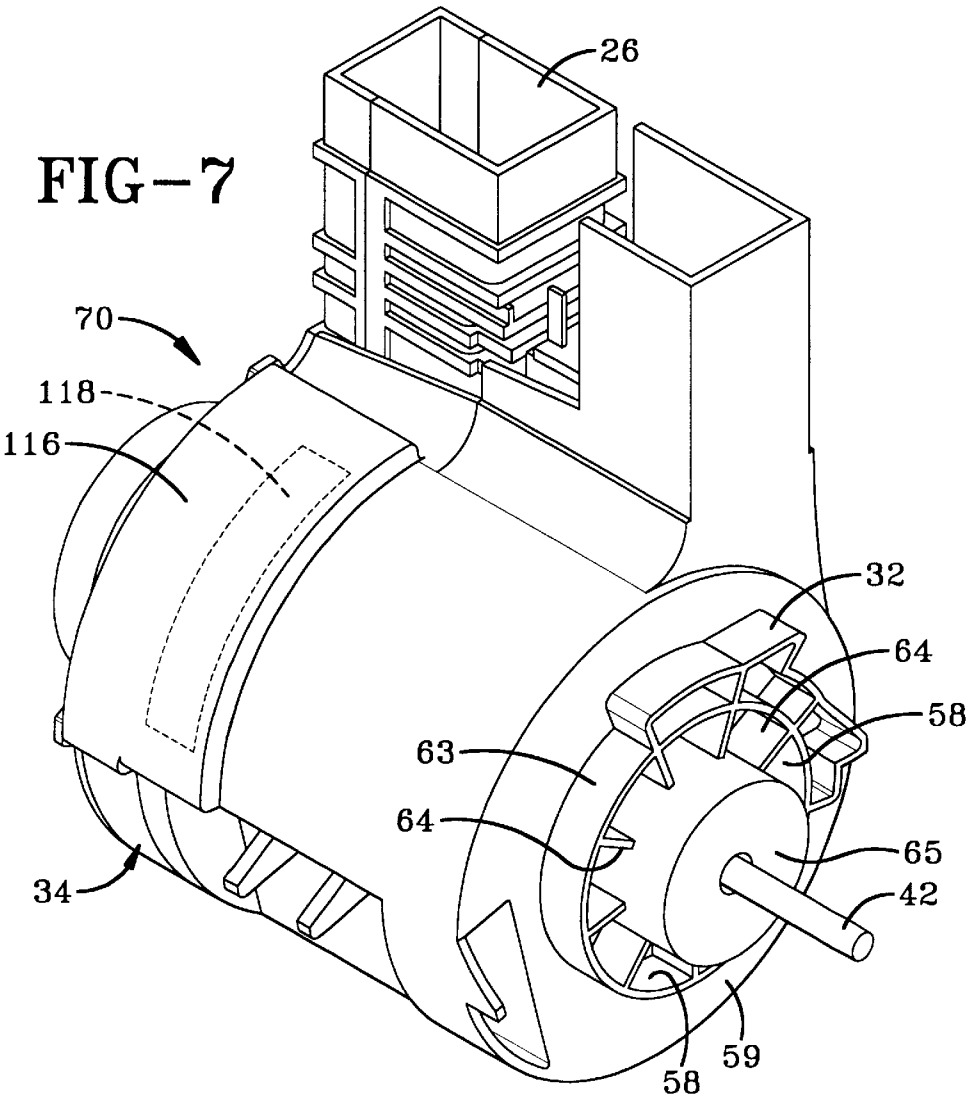
FIG. 7 is a perspective view of a second embodiment of a motor fan assembly according to the present invention.

As shown in FIGS. 7 and 8, motor fan assembly 70 may also include cooling air inlets 114 which are formed substantially around the circumference of motor housing 34. A rounded hood 116 may protrude outwardly from the curved side walls of motor housing 34 forming a channel 118 therebetween. By forming cooling air inlets 114 substantially around the circumference of the motor housing, the cooling air can be more effectively directed about the commutator, amature and field windings thus resulting in more effective cooling of motor 35.

In an alternative embodiment, depicted in FIGS. 14–18 the cooling air is directed into the working air by so called "reverse flow." A motor fan assembly 120 which is similar to motor fan assembly 70 described above includes a housing 134 enclosing a motor 135 (FIG. 16) having a field coil 136, a commutator 137, carbon brushes 139 and a shaft 142. A working fan 145 having blades 146 is coupled to shaft 142 and separated from motor 135 by a wall 147. The wall 147 and housing 134 substantially define a working air chamber 149 having a working air inlet 150 formed therein. Working air inlet 150 is in communication with the nozzle opening 7 such that the fan 145 draws a dirt laden stream of working air into the working air chamber 149, represented by arrows A, FIG. 16. As discussed in the previous embodiment, the working airstream is blown from the chamber 149 to filter bag 24.

Figure 15:
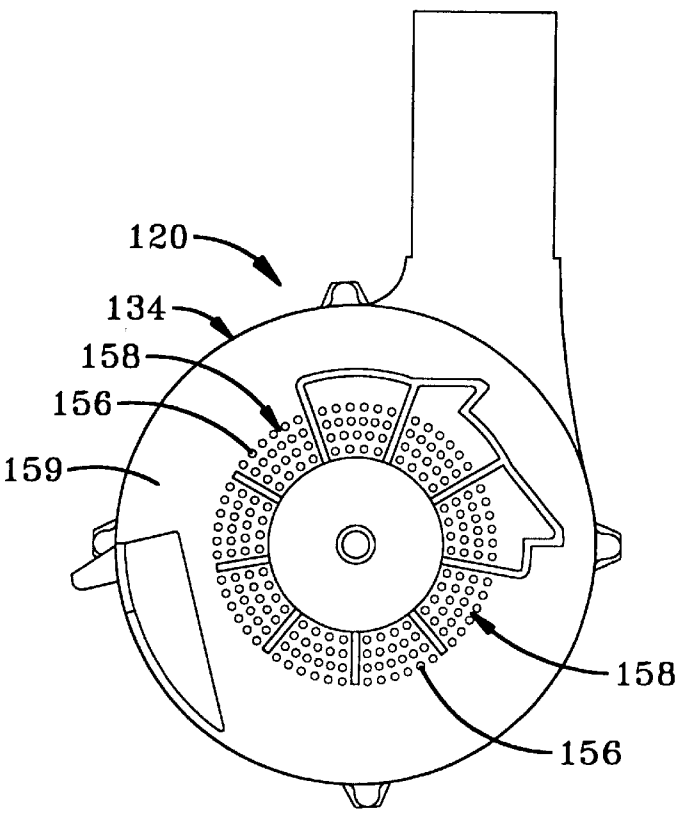
FIG. 15 is a side elevational view thereof;.
Figure 14:
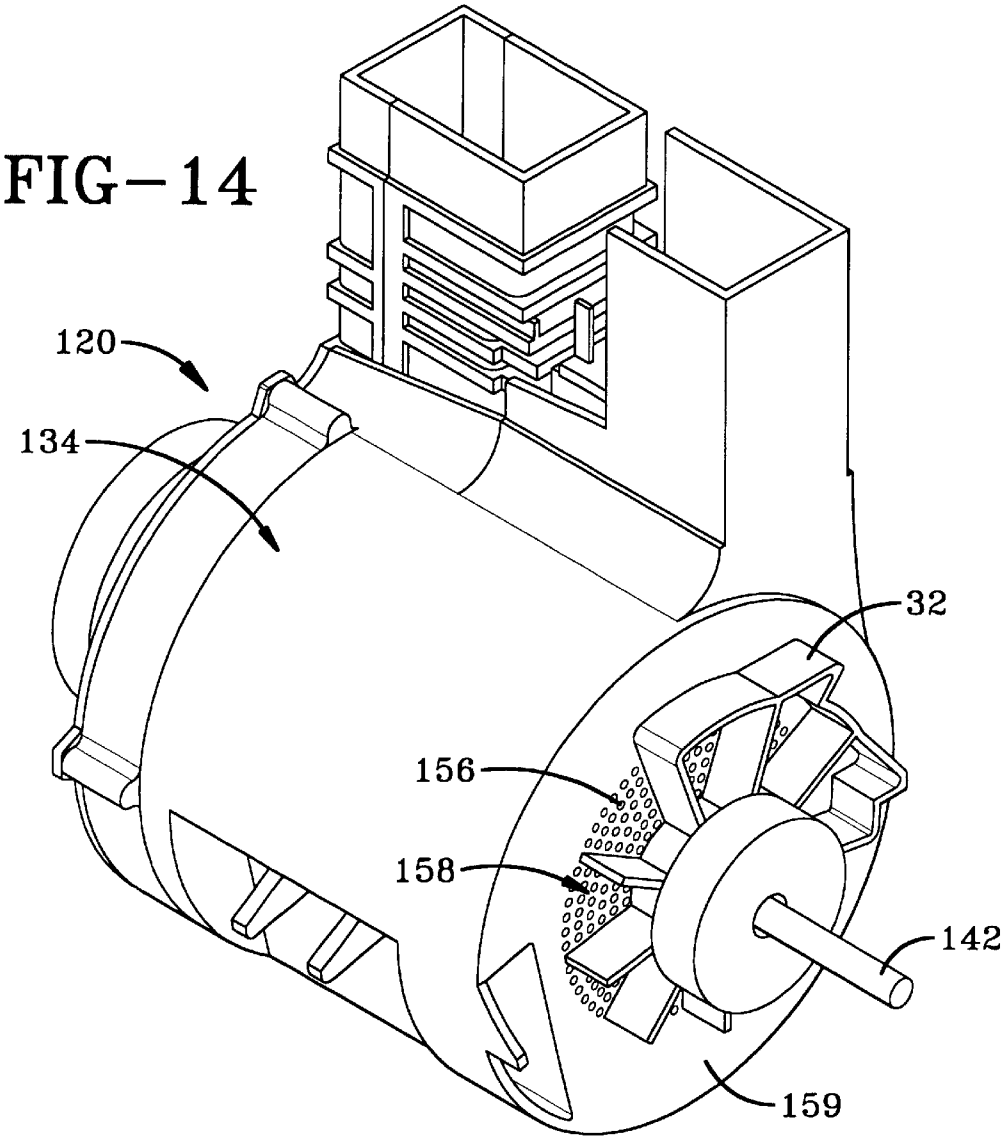
FIG. 14 is a perspective view of a second embodiment of the motor fan assembly.

As shown in FIGS. 14 and 15, the cooling air inlets formed in the front face of the motor housing are sealed as are the openings formed in stepped portion 65 of the motor housing 134. An end 159 of the motor housing, which functioned as the exhaust end of motor fan assembly 70 now functions as the cooling air inlet end of motor fan assembly 120. An opening 158 which functioned as the exhaust openings of motor fan assembly 70 now functions as the cooling air inlet of motor fan assembly 120. The opening or cooling air inlet 158 may be a single opening, a plurality of openings, or a series of perforations 156 formed in housing 134. A lint screen (not shown) may be placed near the inlet 158 such that it filters incoming particulate and prevents the particulate from entering the motor.

Figure 16:
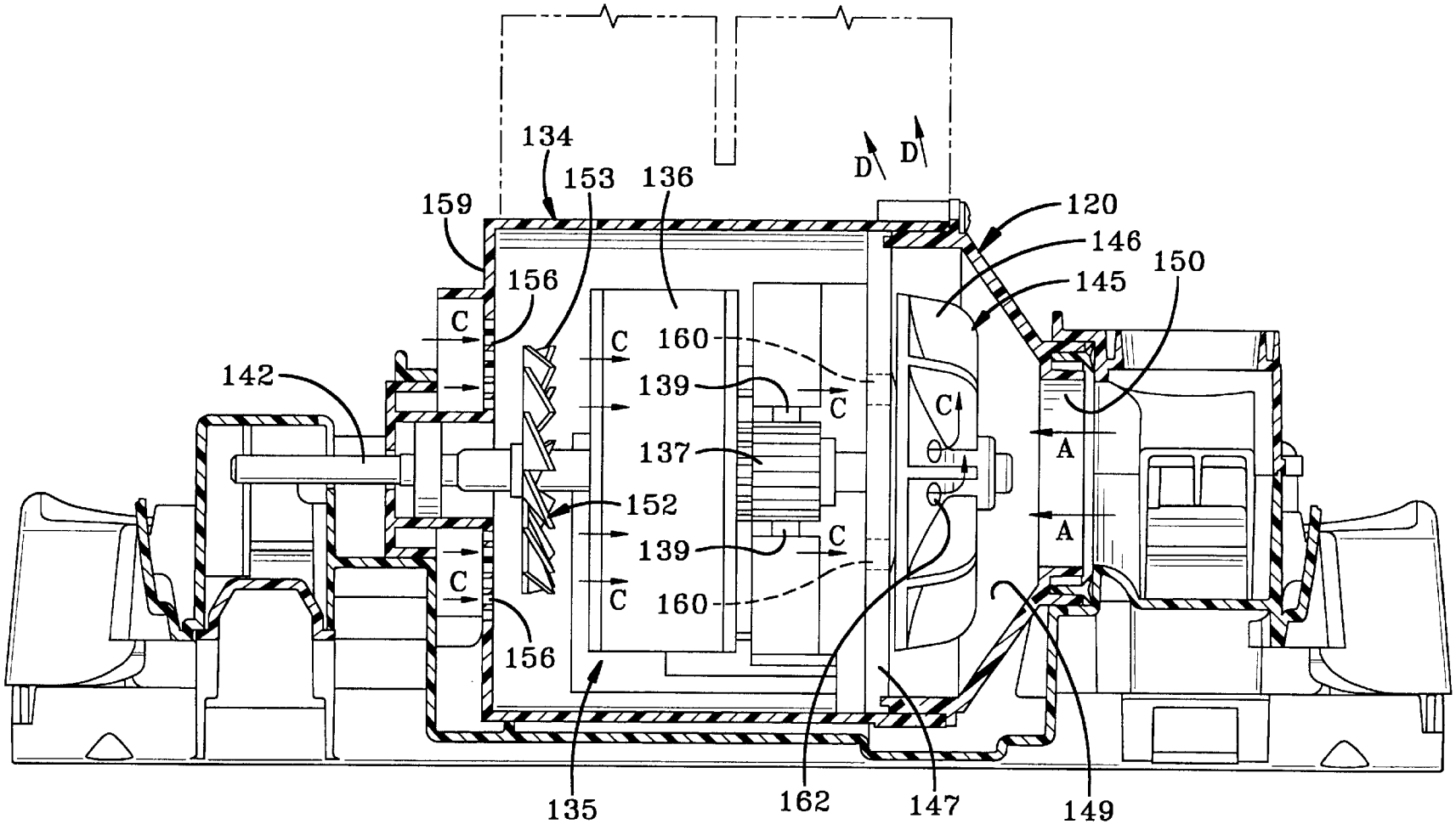
FIG. 16 is a sectional view of the main body of the vacuum cleaner of FIG. 1 depicting the internal components of the second embodiment of the motor fan assembly and further depicting the path of the cooling air.
Figure 18:
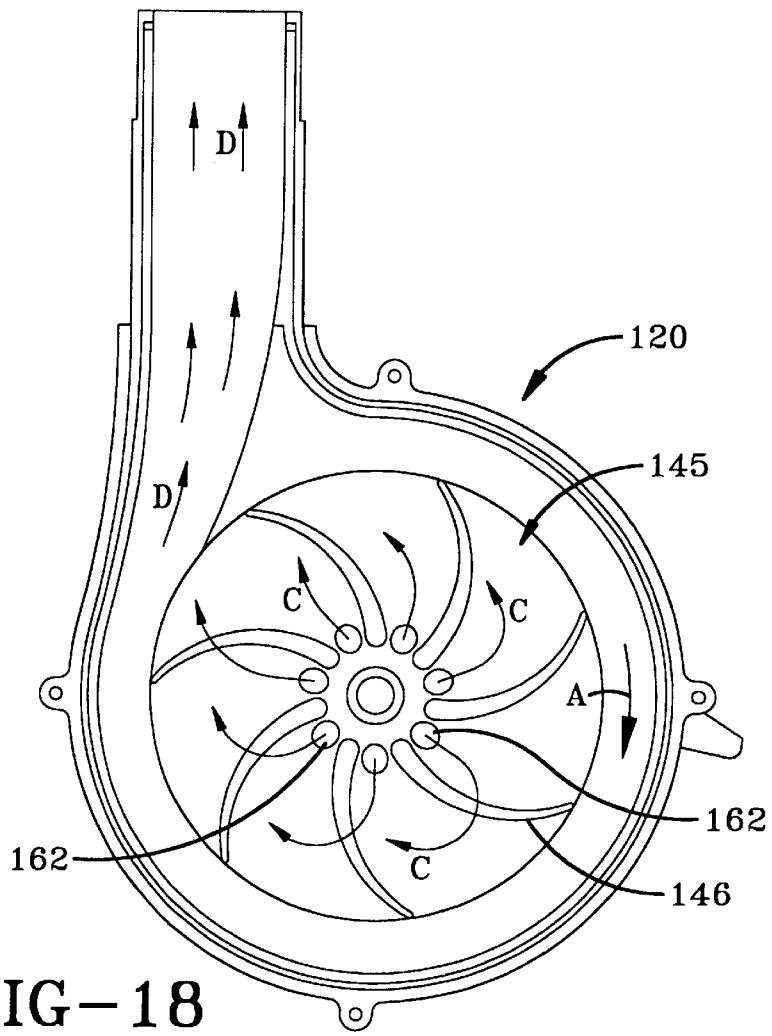
FIG. 18 is a left side elevational view similar to FIG. 15 with the fan in place depicting the flow of cooling air though the holes in the fan and out of the working chamber through an outlet.
Figure 17:
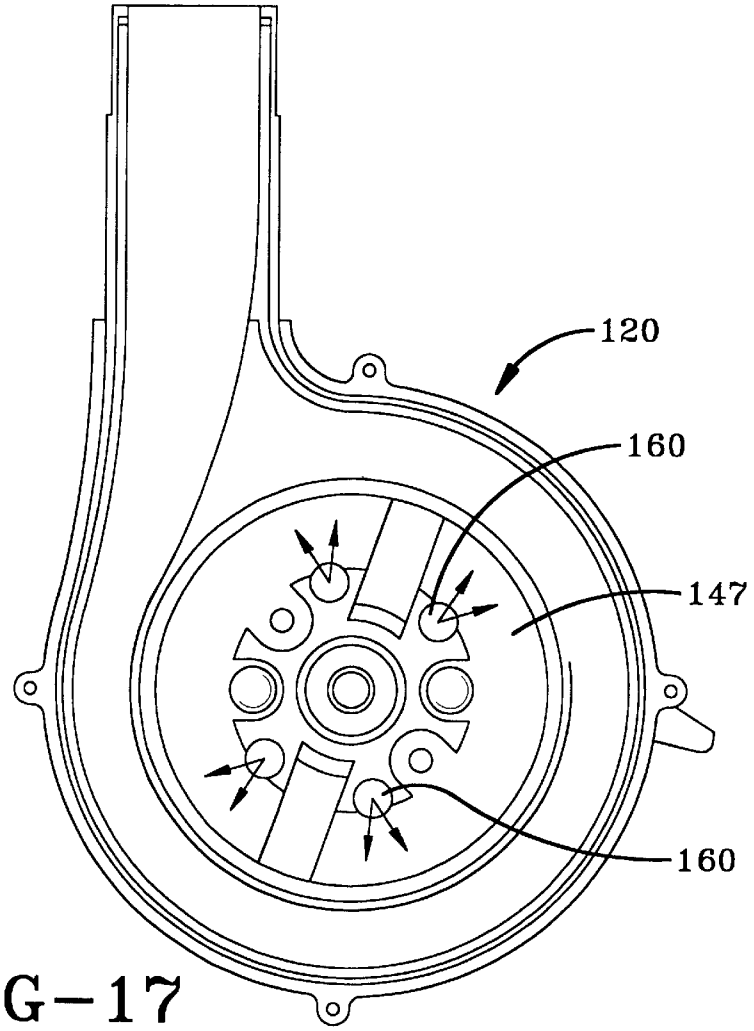
FIG. 17 is a left side elevational view of the motor fan assembly depicted in FIGS. 12–14 with the working end of the housing and fan removed showing holes within the housing wall that allow the cooling air to exit the motor chamber and enter the working fan chamber.

Referring back to FIG. 16, a cooling fan 152 is found within the motor chamber of housing 134 and coupled to shaft 142. The cooling fan 152 includes blades 153 formed to draw cooling air into the motor chamber (arrows C) directing the cooling airstream across the motor 135. Alternatively, a conventional exhaust cooling fan may be operated in reverse to draw air into the housing 134. Referring to FIG. 17, a plurality of holes 160 are formed in wall 147. Referring to FIG. 18, a plurality of holes 162 are formed in working fan 145. Holes 160 and 162 allow the cooling airstream C to enter the working fan chamber 149 (FIG. 14), where it can be combined with the working airstream (arrows A), flow out of the motor housing 134, as indicated by arrows D, and into the filter bag 24. As will be appreciated holes 160 of the wall 147 may be located at a position on wall 147 including near the perimeter, near the shaft 142, or in an intermediate location as shown. The holes 160 may further be spaced to distribute the flow around the motor 135. As with holes 160, holes 162 of working fan 145 may be located anywhere on fan 145. As shown in FIG. 16, holes 162 may be placed between blades 146 and located near the central axis of fan 145 or near shaft 142. As best shown in FIG. 18, the cooling airstream passes through holes 160 and 162 and is directed toward the filter bag 24 by the rotation of fan 145 as indicated by arrows D.

In this embodiment, the cooling air is drawn over substantially the entire exterior surface of the motor 135 resulting in more efficient cooling of the motor 135. The cooling air is then directed into the filter bag 24 by working fan 145 capturing any waste produced by the motor 135 in the filter bag. For example, the carbon particulate given off by a motor having commutator brushes may be collected in filter bag 24. Also, ozone produced by the motor 135 is combined with the working airstream where it may kill entrained bacteria.

Thus it can be seen that at least one of the objects of the invention have been satisfied by the structure presented hereinabove. While in accordance with the patent statutes, the best mode of the invention has been presented and described in detail, the invention is not limited thereto or thereby. Accordingly, for an appreciation of the true scope and breadth of the invention, reference should be made to the following claims.

What is claimed is:

1. A motor-fan assembly for a vacuum cleaner, the motor-fan assembly comprising:

a motor housing having a cooling air inlet, a working air inlet, and a working air outlet formed therein, said working air outlet fluidly communicating with the working air inlet;

a motor positioned within said housing having a motor shaft;

a cooling fan positioned adjacent the cooling air inlet and coupled to the motor shaft, the cooling fan drawing cooling air into the motor housing through the cooling air inlet to cool the motor;

a working fan positioned between the working air inlet and the working air outlet and coupled to the shaft; said working fan drawing working air into the motor housing through the working air inlet and blowing the working air out of the motor housing through the working air outlet;

at least one hole formed in a wall separating the working fan from the cooling air inlet; and at least one hole formed in the working fan allowing the cooling air to flow through the working fan and be blown out the working air outlet.

2. The motor-fan assembly of claim 1, further comprising a lint screen adjacent said cooling inlet.

3. The motor fan assembly of claim 2, wherein the working fan has a central axis, said at least one hole being formed near said central axis.

4. The motor fan assembly of claim 3, wherein the working fan has a plurality of blades and wherein a plurality of holes are formed on said fan, each located between adjacent blades.

* * * * *